US011648571B2

(12) United States Patent
Chen

(10) Patent No.: US 11,648,571 B2
(45) Date of Patent: May 16, 2023

(54) WATER SPRAYER

(71) Applicant: SHIN TAI SPURT WATER OF THE GARDEN TOOLS CO., LTD, Chang-Hua Hsien (TW)

(72) Inventor: Chin-Yuan Chen, Chang-Hua Hsien (TW)

(73) Assignee: SHIN TAI SPURT WATER OF THE GARDEN TOOLS CO., LTD., Chang-Hua Hsien (TW)

( * ) Notice: Subject to any disclaimer, the term of this patent is extended or adjusted under 35 U.S.C. 154(b) by 99 days.

(21) Appl. No.: 17/151,146

(22) Filed: Jan. 16, 2021

(65) Prior Publication Data

US 2022/0226837 A1 Jul. 21, 2022

(51) Int. Cl.
*B05B 1/12* (2006.01)
*B05B 1/30* (2006.01)

(52) U.S. Cl.
CPC ..... *B05B 1/12* (2013.01); *B05B 1/3026* (2013.01)

(58) Field of Classification Search
CPC ..... B05B 1/12; B05B 1/3026
USPC ..... 239/560
See application file for complete search history.

(56) References Cited

U.S. PATENT DOCUMENTS 4,307,840 A * 12/1981 Schulze ..... B05B 1/00 239/DIG. 19
4,541,568 A * 9/1985 Lichfield ..... B60S 3/044 239/441
5,236,129 A * 8/1993 Grime ..... B05B 12/0022 239/289
5,984,207 A * 11/1999 Wang ..... B05B 1/3013 239/526
6,427,931 B1 * 8/2002 Guo ..... B05B 1/30 239/526
7,080,795 B2 * 7/2006 Chen ..... B05B 1/1654 239/394
2009/0205870 A1 * 8/2009 Smith ..... E21B 10/62 175/57
2015/0343467 A1 * 12/2015 Chen ..... B05B 9/01 239/526

* cited by examiner

*Primary Examiner* — Chee-Chong Lee

(57) ABSTRACT

A water sprayer comprising: a main body, a guiding lid, at least one first output nozzle, at least one second nozzle and an output head. The types and rotation sequence of the first nozzle and the second nozzle can be replaced or changed by consumers, so that the water sprayer can be used more easily. Also, when the first nozzle and the second nozzle are damaged or blocked, only the first nozzle or the second nozzle needs to be replaced separately, which is more economical and environmentally friendly.

9 Claims, 8 Drawing Sheets

WATER SPRAYER

BACKGROUND OF INVENTION

Field of Invention

The present invention relates to a water sprayer, and more particular to a water sprayer with replaceable nozzles

Description of Related Art

Currently, the water sprayer can directly control the water output and the shape of the water spray by the components of the water sprayer. Therefore, it is widely used for gardening spraying or vehicle cleaning. A common water sprayer, as shown in FIG. 12, the sprayer 60 comprises a main body 61. The front end of the main body 61 is provided with a rotatable sprinkler head 62. The sprinkler head 62 is integrally formed with one or more sprinkler nozzles 621. When the sprinkler head 62 is rotated, the water can be sprayed out from different sprinkler nozzles 621 which achieves the effect of changing the water output and the shape of the spray. The rear end of the main body 61 is provided with a pressing handle 63 for control, so that the water source can be controlled to open and close through whether the pressing handle 63 is pressed or not.

However, the above-mentioned conventional structure still has the following problems in practical applications: the spray nozzle 621 is integrally formed on the spray head 62, so the spray shape and the rotation sequence is fixed, so that consumers cannot change the shape and rotation sequence of the splash according to their needs or preferences. Furthermore, the nozzles 621 are integrated with the water spray head 62, so when the nozzles 621 is damaged or blocked, the nozzles 621 cannot be replaced separately, and the entire water spray head 62 or even the entire water spray gun 60 needs to be directly replaced, which is wasteful in use.

Therefore, it is desirable to provide a water sprayer with replaceable nozzles to mitigate and/or obviate the aforementioned problems.

SUMMARY OF INVENTION

An objective of present invention is to provide a water sprayer with replaceable nozzles, which is capable of improving the above-mention problems.

In order to achieve the above mentioned objective, A water sprayer comprising: a main body, a guiding lid, at least one first output nozzle, at least one second nozzle and an output head; wherein:

the main body has a handle portion and an extended chamber, the extended chamber is provided with a fitting lip at a front open edge and comprises a supplying tube and a locking socket, the supplying tube connected to the handle portion configured to be connected to a water supply, and the locking socket is disposed in the extended chamber and protrudes from the extended chamber;

the guiding lid has a central hole, a first hole, a second hole, and at least one third hole; the first hole, the second hole and the third hole are evenly arranged around the central hole, and the first hole and the second hole are respectively connected and surrounded by a first neck and a second neck on the guiding lid; the central hole is configured to accept the locking socket such that a back side of the guiding lid pushes against an front open edge of the extended chamber for assembly onto the main body, and a screen is attached onto the first neck;

the first nozzle and the second nozzle each have a cylindrical body; each cylindrical body has a plurality of different spray holes at a front end and a stopping edge at a rear end;

the output head has an assembling aperture at center, and a first sleeve hole, a second sleeve hole, and at least one third sleeve hole disposed around the assembling aperture; each of the first sleeve hole, the second sleeve hole and the third sleeve hole has an internal flange, and when the first nozzle and the second nozzle are respectively placed into the second sleeve hole and the third sleeve hole, the stopping edge of the respective cylindrical body and the flange restrict each other; the assembling aperture accepts the locking socket, and a screw locks the locking socket to assemble the output head onto the fitting lip of the main body, and the output head covers the guiding lid.

Other objects, advantages, and novel features of invention will become more apparent from the following detailed description when taken in conjunction with the accompanying drawings.

DETAILED DESCRIPTION OF PREFERRED EMBODIMENT

Figure 1:
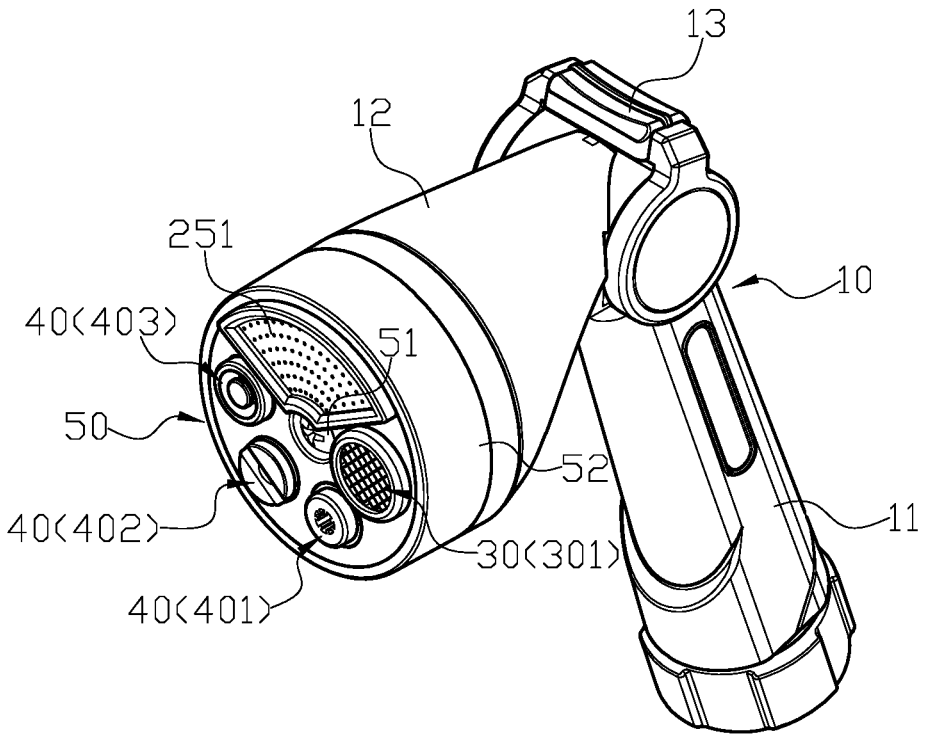
FIG. 1 is a three-dimensional combination drawing of a preferred embodiment according to the present invention.
Figure 2:
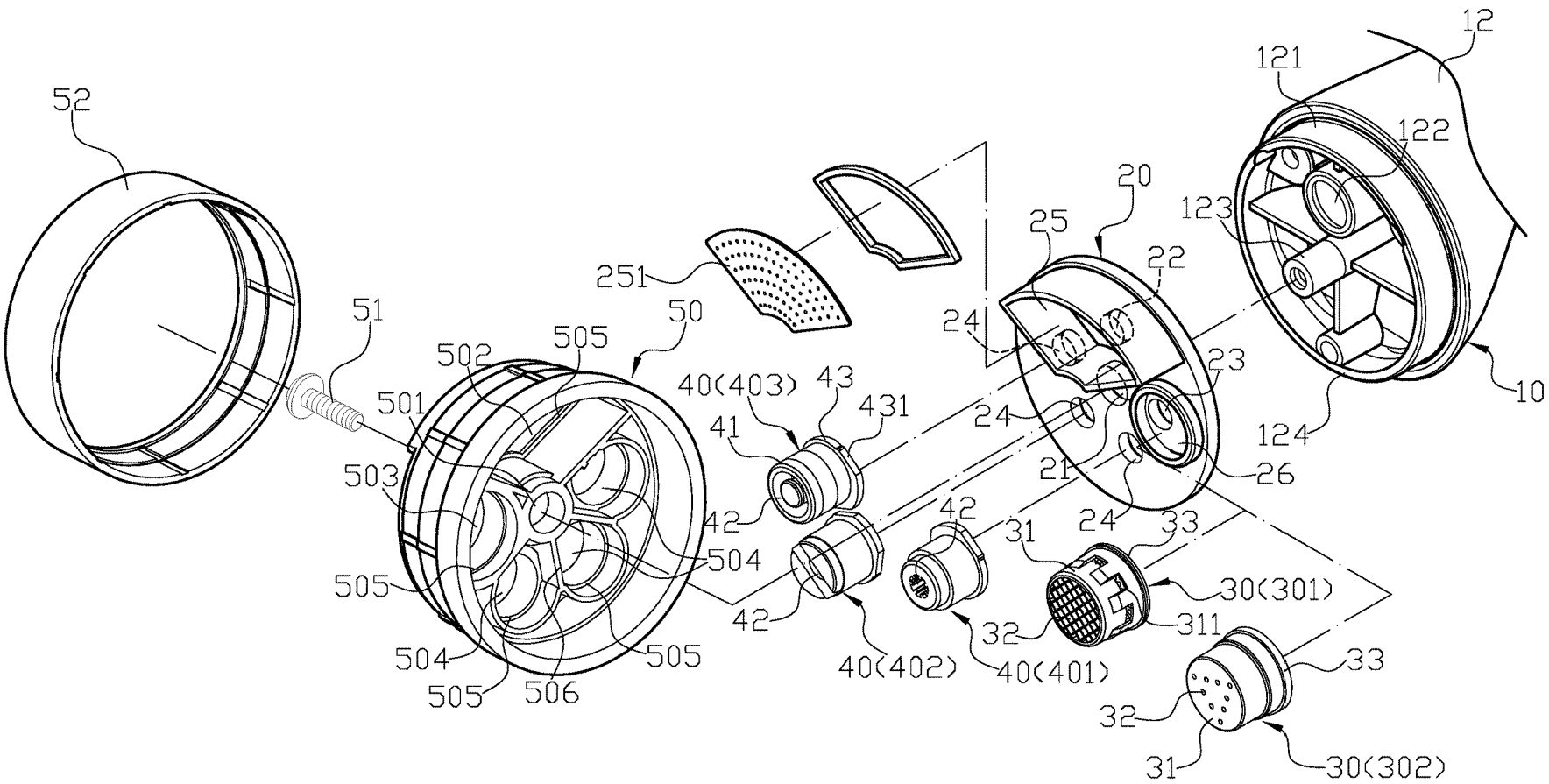
FIG. 2 is a three-dimensional exploded view of the preferred embodiment according to the present invention.

Please refer to FIGS. 1-4. A water sprayer comprises a main body 10, a guiding lid 20, at least one first nozzle 30, at least one second nozzle 40 and an output head 50. The main body 10 has a handle portion 11 and an extended chamber 12, the extended chamber 12 is provided with a fitting lip 121 a front open edge and comprises a supplying tube 122 and a locking socket 123. The supplying tube 122 is connected to the handle portion 11 configured to be connected to a water supply, therefor water passes through the handle portion 11 to enter into the supplying tube 122. The locking socket 123 is disposed in the extended chamber and protrudes from the extended chamber as a front open edge 124. The guiding lid 20 has a central hole 21, a first hole 22, a second hole 23 and at least one third hole 24. The first hole 22, the second hole 23 and the third hole 24 are evenly arranged around the central hole 21, the first hole 22 and the second hole 23 are respectively connected and surrounded by a first neck 25 and a second neck 26 on the guiding lid 20. The central hole 21 is configured to accept the locking socket 123 such that a back side of the guiding lid 20 pushes against an front open edge 124 of the extended chamber 12 for assembly onto the main body 10. Since the guiding lid 20 is rotatable, the supplying tube 122 can be selectively aligned with the first hole 22, the second hole 23 or the third hole 24. The front end of the first neck 25 and the second neck 26 are exposed, and a screen 251 is attached onto the first neck 25. The first nozzle 30 and the second nozzle 40 each have a cylindrical body 3141, and each cylindrical body 3141 has a plurality of different spray holes 3242 at a front end and a stopping edge 3343 at a rear end. The output head 50 has an assembling aperture 501 at center, and a first sleeve hole 502, a second sleeve hole 503 and at least one third sleeve hole 504. Each of the first sleeve hole 502, the second sleeve hole 503 and the third sleeve hole 504 has a flange 505, when the first nozzle 30 and the second nozzle 40 are respectively placed into the second sleeve hole 503 and the third sleeve hole 504, so the stopping edge 3343 of the respective cylindrical body 3141 and the flange 505 restrict each other. Therefore, the first nozzle 30 and the second nozzle 40 can only protrude its front end out from the output head 50. The assembling aperture 501 accepts the locking socket 123, and a screw 51 locks the locking socket 123 to assemble the output head 50 onto the fitting lip 12 of the main body 10, and the output head 50 covers the guiding lid 20. The front end of the flange 505 and the second neck 26 are clamped to the screen 251 and the first nozzle 30 respectively, and the front end with the third hole 24 of the guiding lid 20 helps the rear end of the second nozzles 40 to be aligned. Because the first neck 25 and the second neck 26 protruding from the front end of the guiding lid 20 are inserted into the first sleeve hole 502 and the second sleeve hole 503 respectively, when the output head 50 is assembled, the output head 50 and the guiding lid 20 can move simultaneously, so that when the output head 50 rotates, the guiding lid 20 is driven to rotate too. Since the output head 50 can be disassembled, the output head 50 and the guiding lid 20 can also be separated smoothly in order to change the first nozzle 30 or at least one second nozzle 40 with different sprayer shapes. Therefore, the water sprayer can be more flexible and changeable, and more tailored to individual conditions.

Moreover, the fitting lip 121 is configured to have a reduced diameter corresponding to the extended chamber 12.

Furthermore, the main body has a control knob 13 for controlling water flow.

In addition, the first neck 25, the screen 251 and the first sleeve hole 502 all have a corresponding fan shape.

Additionally, the first nozzle 30 is a foam nozzle 301 having a plurality of apertures 311 on the cylindrical body 31 and at least one aerating mesh 34 and a mesh spray hole 32 disposed at a front end of the cylindrical body 31. Using the apertures 311 to introduce the air and break the water flow, it makes the water contain a lot of bubbles. Then, the foamy water is sprayed from the spray hole 32 of the foam nozzle 301, which can create a large flow illusion with a actual small flow to achieve the effect of saving water, please refer to FIG. 6 and FIG. 7.

Figure 8:
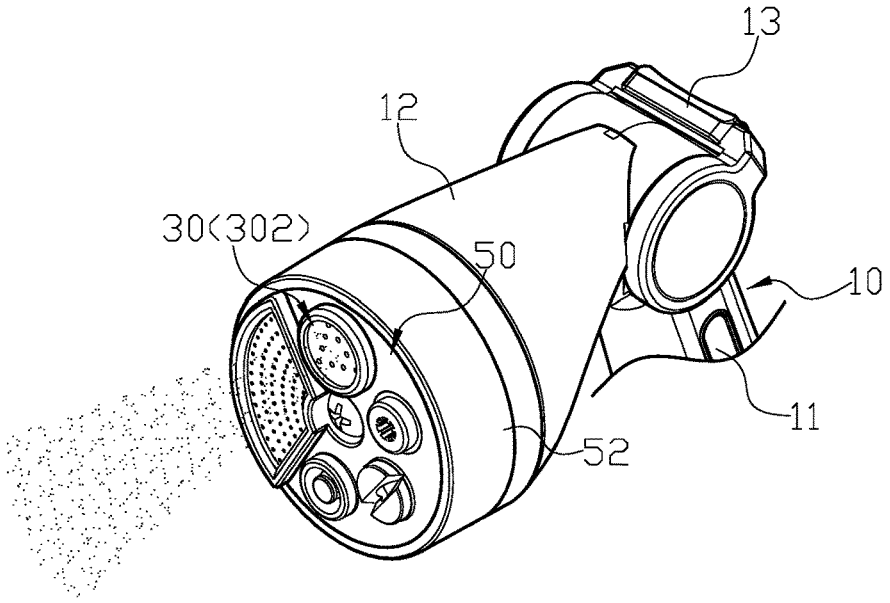
FIG. 8 shows water coming out after the foam nozzle is replaced by the mist nozzle according to the present invention.

Moreover, the first nozzle 30 is a mist nozzle 302, as shown in FIG. 8.

Furthermore, the second nozzle 40 is a foam nozzle 301 or a mist nozzle 302.

Figure 9:
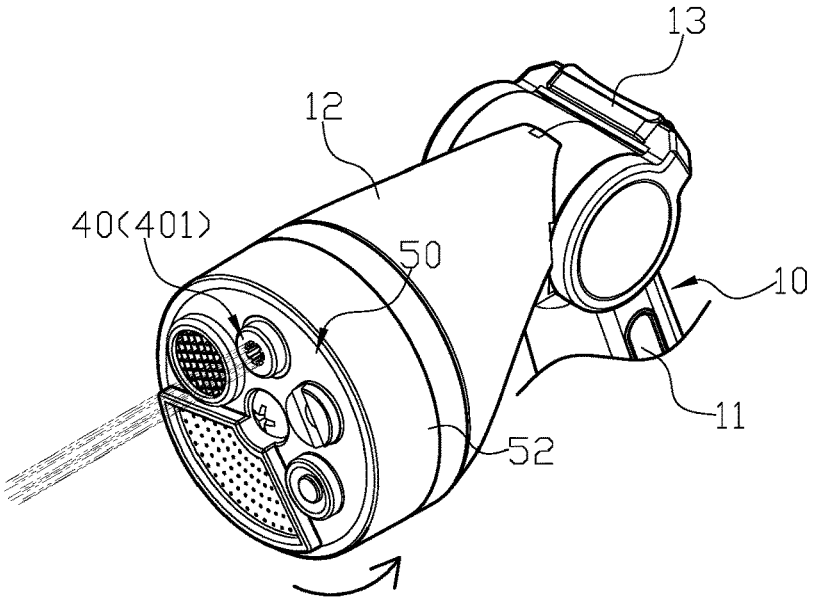
FIG. 9 is a three-dimensional view showing water coming out the linear jet nozzle of the output head according to the present invention.

In addition, the second nozzle 40 is a straight-line jet nozzle 401 as shown in FIG. 9.

Figure 10:
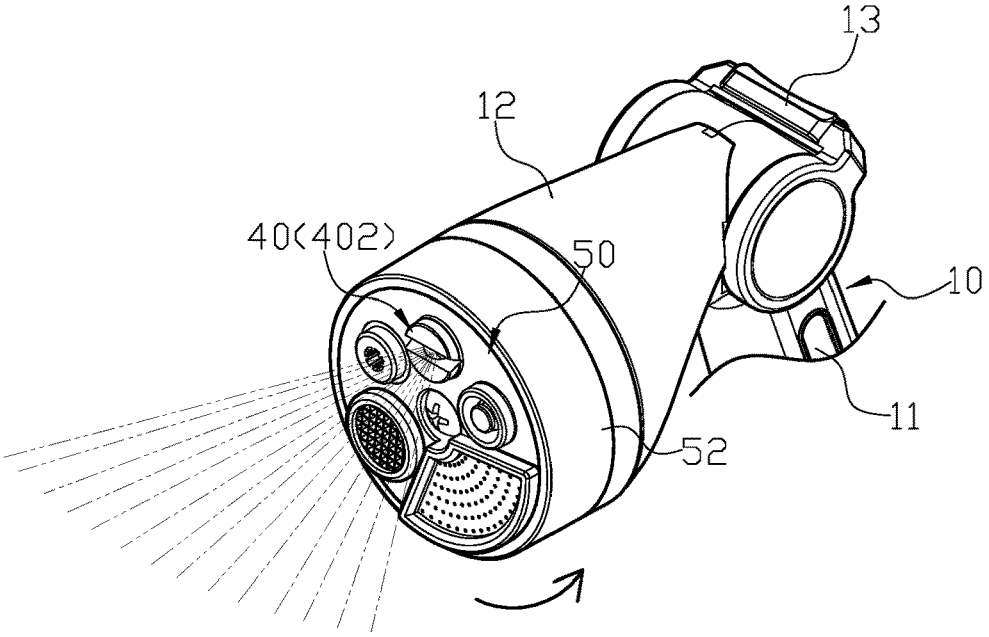
FIG. 10 is a three-dimensional view showing water coming out the flat spray head of the output head according to the present invention.

Besides, the second nozzle 40 is flat jet nozzle 402, as shown in FIG. 10.

Figure 11:
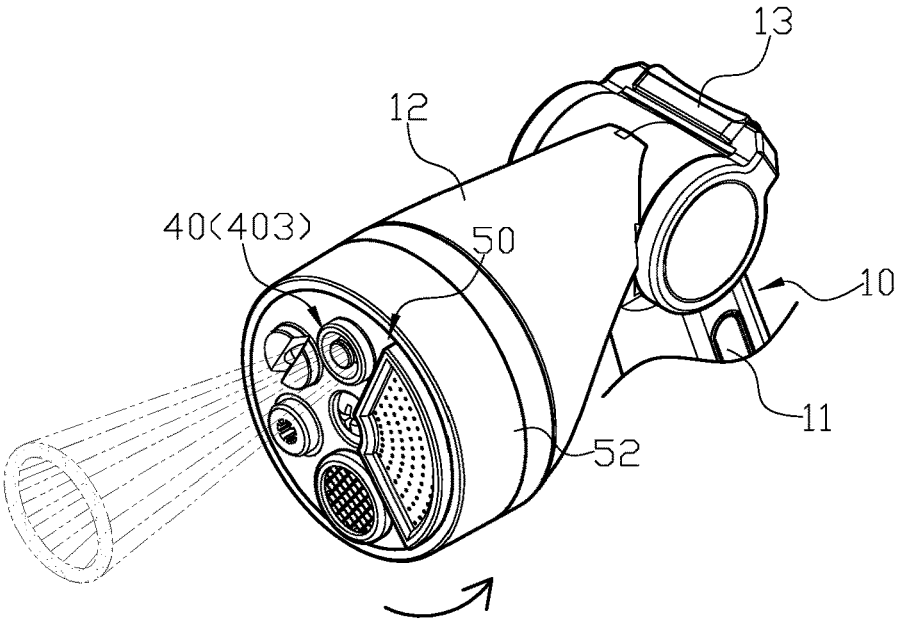
FIG. 11 is a three-dimensional view showing water coming out the cone-shaped spray nozzle of the output head according to the present invention.
Figure 12:
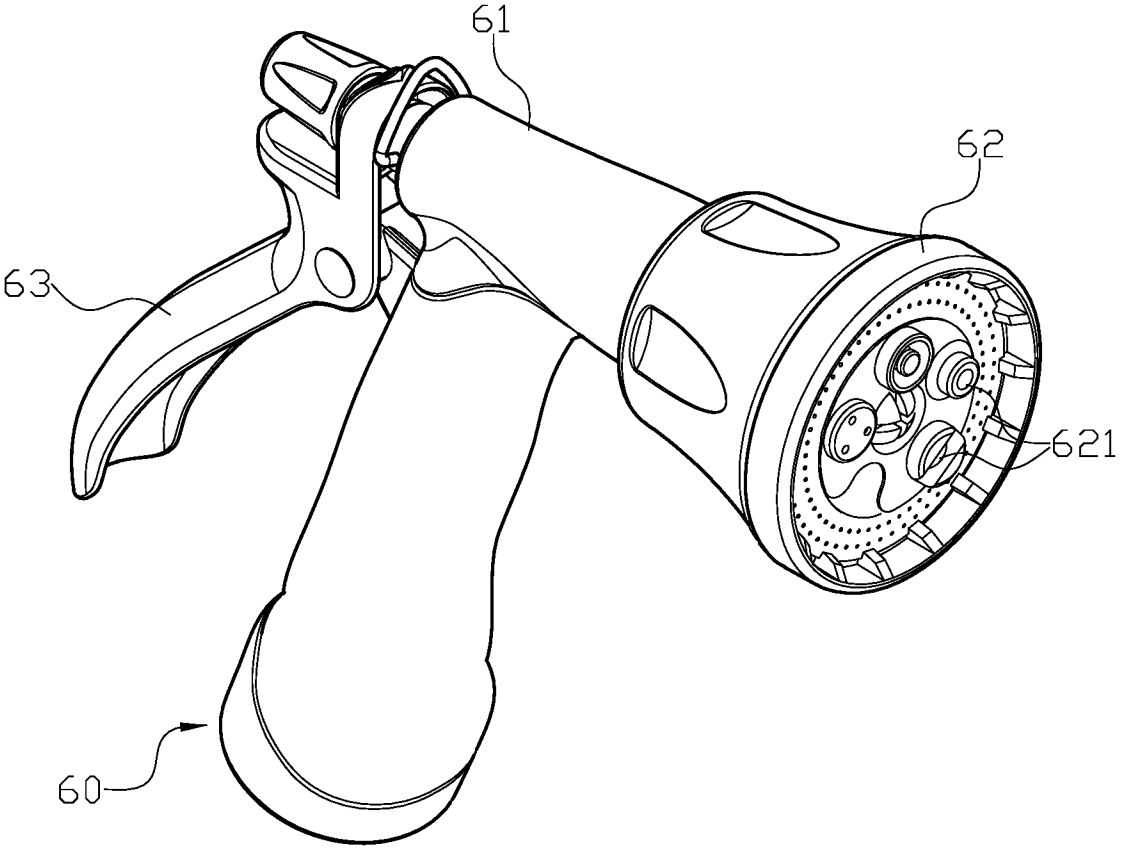
FIG. 12 PRIOR ART
FIG. 12 is a structure drawing of a conventional water sprayer.

Alternatively, the second nozzle 40 is a cone-shaped jet nozzle 403, as shown in FIG. 11.

Moreover, the second nozzle 40 is a thick cylindrical nozzle.

Furthermore, the second nozzle 40 is a thin cylindrical nozzle.

In additional, the second nozzle 40 is a conical nozzle.

Likewise, the second nozzle 40 is a multi-point linear nozzle.

Besides, the water sprayer might have all of the straight-line jet nozzle 401, the flat jet nozzle 402, and the cone-shaped jet nozzle 403 or other replaceable second nozzle 40.

Figure 3:
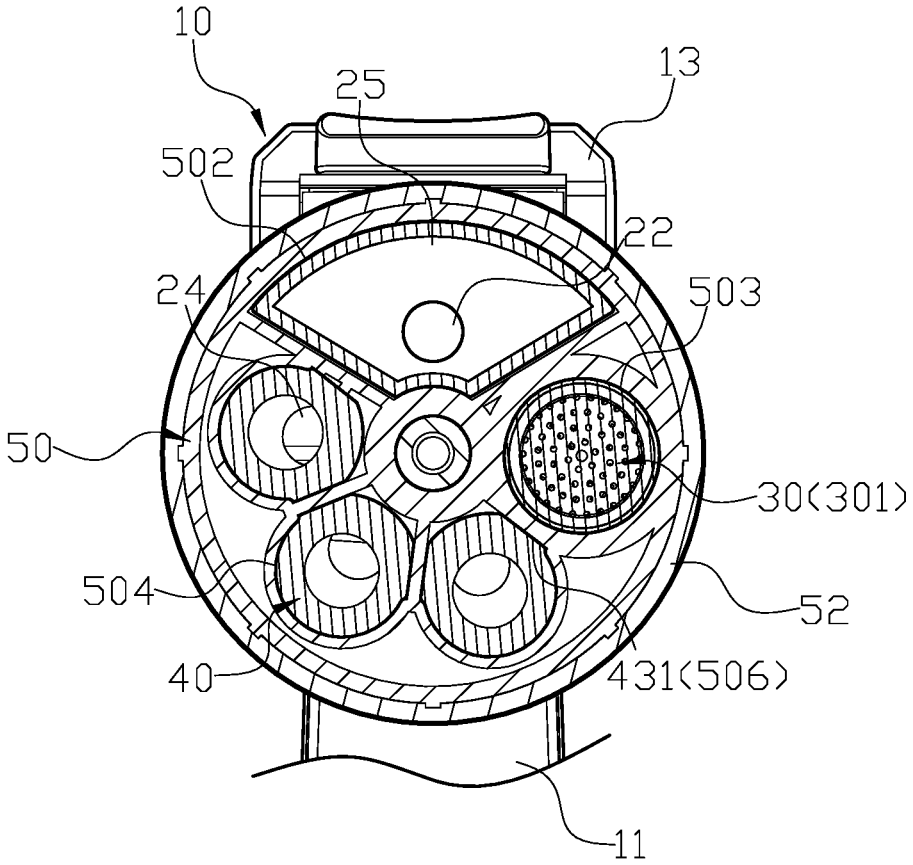
FIG. 3 is a sectional view of the combination of the preferred embodiment according to the present invention.
Figure 4:
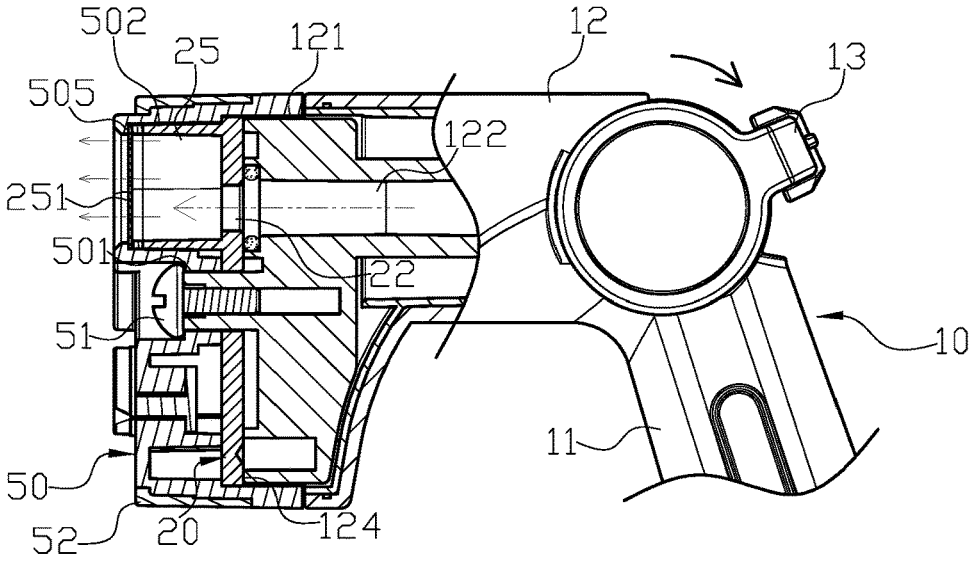
FIG. 4 is a cross-sectional view of the water sprayer of the preferred embodiment according to the present invention.
Figure 5:
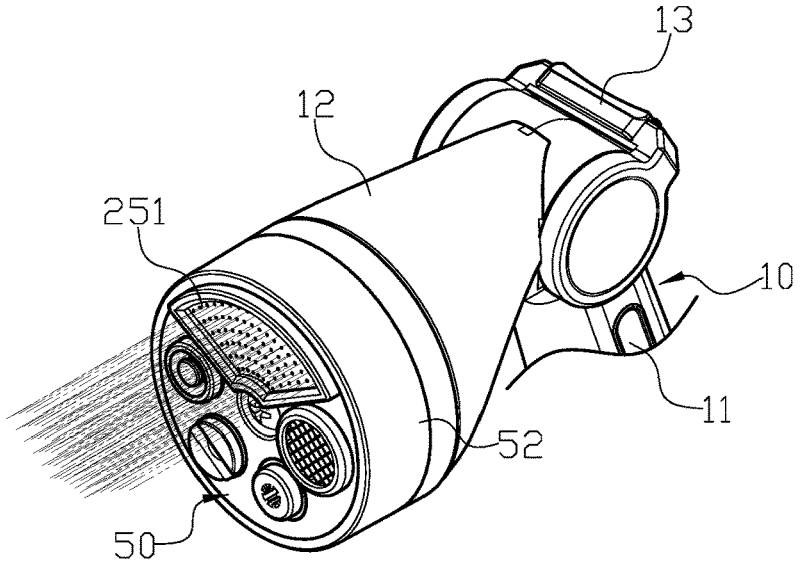
FIG. 5 is a three-dimensional view showing water coming out from the screen according to the present invention.

Also, the stopping edge 43 of the second nozzle 40 and the third sleeve hole 504 of the output head 50 respectively have corresponding beveled edges 431, 506 for securing purposes, as shown in FIG. 3.

Moreover, the output head 50 is sleeved with a gripping ring 52.

Furthermore, the water sprayer further comprises a positioning device for alignment.

In addition, the water sprayer further comprises a plurality of sealing rings.

Figure 6:
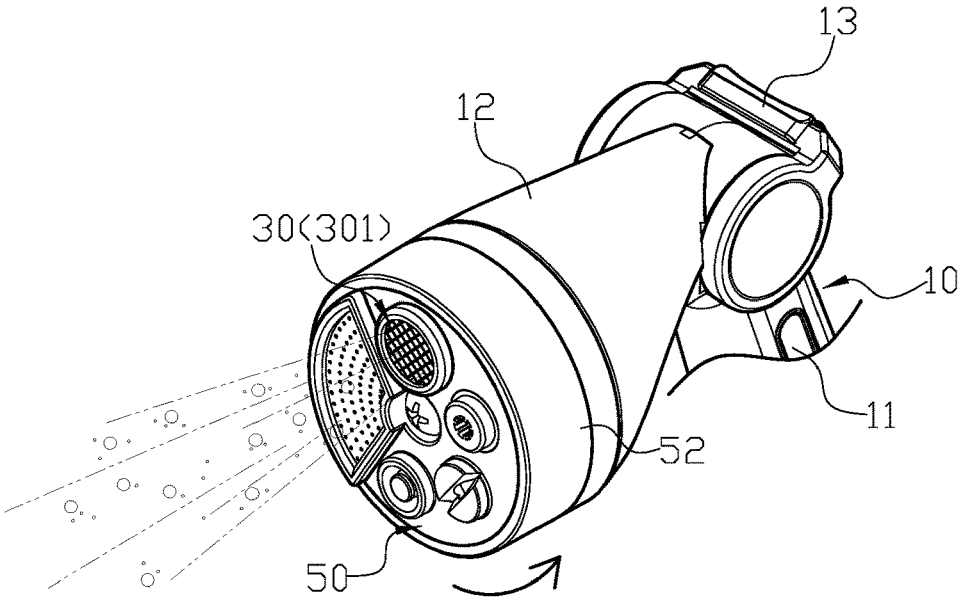
FIG. 6 is a three-dimensional view showing water coming out from the foam nozzle after the output head being rotated according to the present invention.
Figure 7:
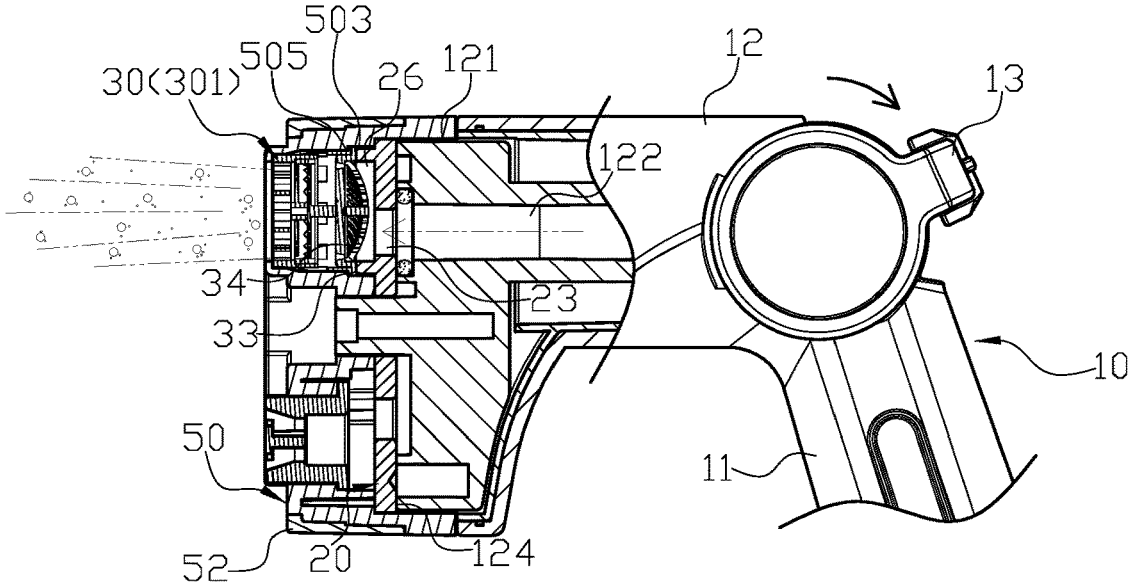
FIG. 7 is a cross-sectional view showing water coming out from the foam nozzle according to the present invention.

Please refer to FIG. 4 to FIG. 11. In actual use, the output head 50 is used to drive the guiding lid 20 to rotate so that the supplying tube 122 can be aligned with the first hole 22 and the second hole 23 or the third hole 24 to match the screen 251, the first nozzle 30 and the second nozzle 40, the spray hole, to change the water output and the shape of the spray of the water sprayer. Water supplied from the supplying tube 122 passes through the first hole 22, the second hole 23 or the third hole 24 and enters in the screen 251, the first nozzle 30 or the second nozzle 40, so that water sprayer can be used for multiple purposes. Moreover, by removing the output head 50, the rotation sequence of the first nozzle 30 and the second nozzle 40 can be changed, as shown in FIG. 6 and FIG. 8, the second sleeve hole 503 can be installed with different first nozzles 30, so that the use of water sprayer is no longer be restricted by the original factory's design, but can be more flexible. Alternatively, when the first nozzle 30 or the second nozzle 40 are damaged or blocked, it can also be replaced.

The above-mentioned water sprayer with replaceable nozzles has the following advantages: The types and rotation sequence of the first nozzle 30 and the second nozzle 40 can be replaced or changed by consumers, so that the water sprayer can be used more easily. Also, when the first nozzle 30 and the second nozzle 40 are damaged or blocked, only the first nozzle 30 or the second nozzle 40 needs to be replaced separately, which is more economical and environmentally friendly.

Although the present invention has been explained in relation to its preferred embodiment, it is to be understood that many other possible modifications and variations can be made without departing from the spirit and scope of invention as hereinafter claimed.

What is claimed is:

1. A water sprayer comprising:

a main body, a guiding lid, at least one replaceable first output nozzle, at least one replaceable second nozzle, and an output head;

wherein:

the main body has a handle portion and an extended chamber, the extended chamber comprising a fitting lip at a front open edge, a supplying tube, and a locking socket, the supplying tube fluidly connected to the handle portion and configured to be connected to a water supply;

the guiding lid has a central hole, a first hole, a second hole, and at least one third hole; the first hole, the second hole and the at least one third hole are arranged around the central hole, and the first hole and the second hole are respectively surrounded by a first neck and a second neck that both protrude from the guiding lid; the central hole is configured to accept the locking socket such that a back side of the guiding lid pushes against the front open edge of the extended chamber for rotatably assembly onto the main body, and a screen is attached onto the first neck;

the at least one first nozzle and the at least one second nozzle each have a cylindrical body; each cylindrical body has a plurality of different spray holes at a front end and a stopping edge at a rear end, the second neck engaging the at least one first nozzle;

the output head has an assembling aperture at center, and a first sleeve hole, a second sleeve hole, and at least one third sleeve hole disposed around the assembling aperture; each of the first sleeve hole, the second sleeve hole and the third sleeve hole has an internal flange, and when the at least one first nozzle and the at least one second nozzle are respectively removably disposed into the second sleeve hole and the third sleeve hole, the stopping edge of the respective cylindrical body and the flange restrict each other, and the stopping edge of the first nozzle is disposed between the internal flange of the second sleeve hole and the second neck; the assembling aperture accepts the locking socket, and a screw locks the locking socket to assemble the output head onto the fitting lip of the main body, and the output head covers the guiding lids;

wherein the output head and the guiding lid are rotatable around the locking socket to selectively fluidly connect one of the first sleeve hole, the second sleeve hole, or the at least one third sleeve hole with the supplying tube; and wherein the stopping edge of the at least one second nozzle and the third sleeve hole of the output head respectively have corresponding beveled edges for securing purposes.

2. The water sprayer as claimed in claim 1, wherein the fitting lip is configured to have a reduced diameter corresponding to the extended chamber.

3. The water sprayer as claimed in claim 1, wherein the main body has a control knob for controlling water flow.

4. The water sprayer as claimed in claim 1, wherein the first neck, the screen and the first sleeve hole all have a corresponding fan shape.

5. The water sprayer as claimed in claim 1, wherein the at least one first nozzle comprises a foam nozzle having a plurality of apertures on the cylindrical body of the at least one first nozzle and at least one aerating mesh and a mesh spray hole disposed at a front end of the cylindrical body of the at least one first nozzle.

6. The water sprayer as claimed in claim 1, wherein the at least one first nozzle comprises a mist nozzle.

7. The water sprayer as claimed in claim 1, wherein the at least one second nozzle comprises any one of a straight-line jet nozzle, flat jet nozzle, cone-shaped jet nozzle, thick cylindrical nozzle, thin cylindrical nozzle, conical nozzle, or multi-point linear nozzle.

8. The water sprayer as claimed in claim 1, wherein the output head is sleeved with a gripping ring.

9. The water sprayer as claimed in claim 1, wherein the water sprayer further comprises a positioning device for alignment.

* * * * *